US005544462A

United States Patent [19]

Kordes

[11] Patent Number: 5,544,462

[45] Date of Patent: Aug. 13, 1996

[54] MOVABLE WALL SYSTEM

[75] Inventor: Herbert Kordes, Bad Salzuflan, Germany

[73] Assignee: DORMA GmbH + Co. KG, Ennepetal, Germany

[21] Appl. No.: 147,769

[22] Filed: Nov. 2, 1993

Related U.S. Application Data

[63] Continuation-in-part of PCT/DE92/00951, Nov. 11, 1992.

[51] Int. Cl.[6] ..... E05D 3/02

[52] U.S. Cl. ..... 52/243.1; 52/65; 52/241; 160/196.1

[58] Field of Search ..... 160/196.1, 200, 160/205; 49/409, 410; 16/71; 52/65, 241, 243.1, 238.1

[56] References Cited

U.S. PATENT DOCUMENTS

| | | | |
|---|---|---|---|
| 3,091,819 | 6/1963 | Wheeler et al. . | |
| 3,149,366 | 9/1964 | Martin . | |
| 3,925,933 | 12/1975 | Reuter | 49/409 |
| 4,376,323 | 3/1983 | Tillmann | 16/71 X |
| 4,991,257 | 2/1991 | Eutebach | 160/196.1 X |
| 5,031,274 | 7/1991 | Eutebach . | |

FOREIGN PATENT DOCUMENTS

| | | | |
|---|---|---|---|
| 968225 | 5/1975 | Canada | 49/409 |
| 3611379 | 10/1987 | Germany | 16/71 |
| 4133578 | 4/1993 | Germany | 16/71 |
| 92012316 | 7/1992 | WIPO | 49/409 |
| 94011607 | 5/1994 | WIPO | 16/71 |

*Primary Examiner*—Carl D. Friedman
*Assistant Examiner*—Yvonne Horton-Richardson
*Attorney, Agent, or Firm*—Nils H. Ljungman and Associates

[57] ABSTRACT

A door closer for a door of a movable wall element can preferably be configured for being disposed in a frame of the wall element for movement along with the wall element. The door closer can preferably be coupled to the door via a coupling pin in the door and a hole located in the drive shaft outlet of the door closer, which hole preferably runs perpendicular to the frame profile. Such an installation can be realized on existing door systems, without requiring complex and expensive caulking work in the floor.

15 Claims, 5 Drawing Sheets

MOVABLE WALL SYSTEM

This application is a continuation-in-part application of International Application No. PCT/DE92/00951, filed on Nov. 11, 1992 which is based on Federal Republic of Germany Patent Application No. P 41 33 578, filed on Oct. 10, 1991. International Application No. PCT/DE92/00951 was pending as of the filing date of U.S. application Ser. No. 08/147,769 and the U.S. was an elected state in International Application No. PCT/DE92/00951.

BACKGROUND OF THE INVENTION

1. Field of the Invention

This invention relates to a door closer which is hung in a frame of a bulk-head or glass entry facade, which consists in particular of several wall elements which can be combined, in which each wall element is equipped individually with at least one supporting apparatus, and which is movably supported in a ceiling rail.

2. Background Information

This type of wall element is preferably used in the facades of buildings, in particular, stores and restaurants, to keep the storeroom open or closed, depending on the weather. For this reason, it must be possible to park the entire facade in a lateral position, so that it does not interfere with the traffic of entering and exiting patrons. Inside these movable wall elements, there is generally a door, preferably an all-glass door, but one which can also be enclosed in a frame. So that this door does not stay open in cold weather when the facade is closed, these doors are also equipped with door closers. These door closers are recessed in the floor, and above their projecting shaft have a coupling to the door panel located above. This coupling is generally made by means of a shaft which projects from the door closer. But such a projecting shaft represents a hazard, especially when the entire wall element has been placed in its parked position. Because in this position, the floor is exposed, and pedestrians could trip over the projecting shaft. The holes for the coupling located at the floor level also get dirty as a result of pedestrian traffic. On the basis of this prior art, European Patent Application 0 340 795 A2 discloses a floor-concealed door closer for swinging, and/or oscillating doors. In that case, an adapter is bolted to the underside of the door, and with its projecting shaft forms the connection to the door closer which is recessed in the ground.

OBJECT OF THE INVENTION

The object of the invention is to create an easy-to-install coupling between a door closer and an all-glass or frame door panel which has been pre-assembled with all its armatures. The installation of a door closer should also be possible in an existing structure, but here it should be noted that the door closer, e.g. as with the floor-concealed door closer, is not visible to the user.

SUMMARY OF THE INVENTION

The invention teaches that this object can be achieved by the installation of a door closer for framed doors inside the sleeper lying above the door, so that the door closer is not visible to the user. This frame-mounted door closer has a drive shaft extending toward the ground and equipped with a hole which runs through it perpendicular to the front of the wall. Engaged in this hole is a coupling pin pre-mounted on the door panel, which is connected to the armature of the door. This coupling pin is secured by a threaded connection, and there is a normal swinging operation of the door. The particular advantage of this coupling lies in the fact that the entire door element can be preassembled with all its armatures, and need only be installed on the construction site. There is only one additional hole for the axle bearing in the ground. To erect the door, the door is first placed on the axle bearing, and by tipping the door upright from its diagonal position, the coupling pin is inserted into the hole in the frame-mounted door closer and secured. An additional advantage over conventional floor-concealed door closers is that there is no need for complex and tedious caulking work in the vicinity of the floor for the large cement housings of the floor-concealed door closer. With existing systems, this is a very important feature, because this work on the floor can cause enormous damage to the floor covering. The door can be adjusted to compensate for any imprecision in the height of the door by means of a levelling screw which is located above the frame door closer. Such a door system can also be used as a normally accessible door.

The invention is explained below with reference to one possible embodiment illustrated in the accompanying drawings.

DESCRIPTION OF THE PREFERRED EMBODIMENTS

Figure 1:
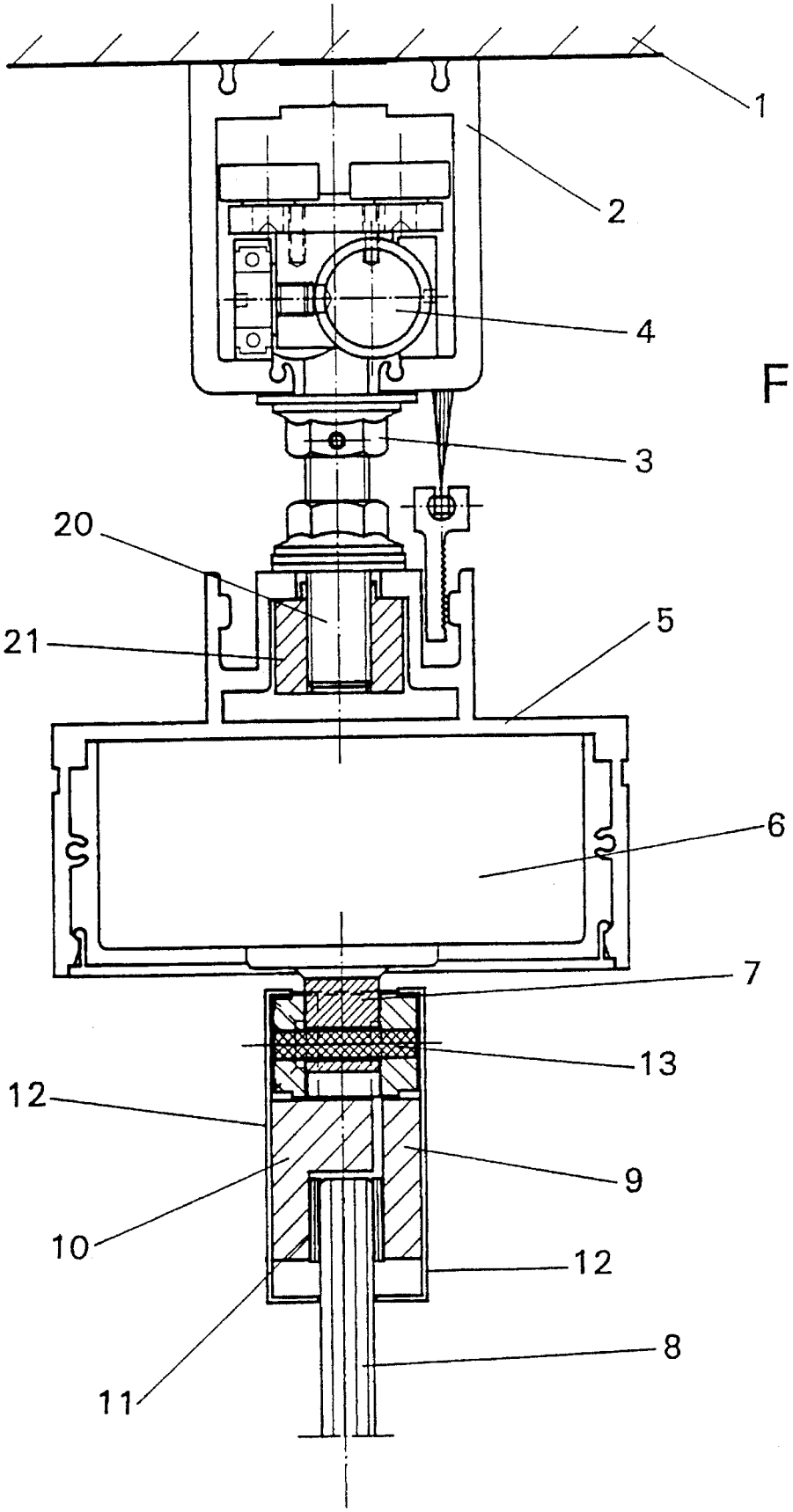
FIG. 1 shows the hanging of the door in cross section.

The roller track (2) is fastened to the ceiling (1). Inside the roller track (2) there are rollers (4), to which the frame profile (5) is attached by means of the height adjustment (3), the pivot (20) and the thrust bearing (21). This frame profile (5) runs at right angles over the entire width of the door. For cosmetic reasons, however, it is also possible to run this profile over the entire width of the wall when uniform elements are used. Inside the frame profile (5) is the frame-mounted door closer (6). This frame-mounted door closer is installed so that its drive shaft (7) which projects on one side, points toward the floor (18). As a result of the integration of the frame-mounted door closer (6) into the frame profile (5), only the drive shaft (7) is visible from the outside when the door is not being used. The drive shaft (7) has a transverse hole which runs perpendicular to the door or the facade, i.e. in the direction of travel of the user. This hole (14) is designed to hold the coupling of the door closer to the door.

Figure 2:
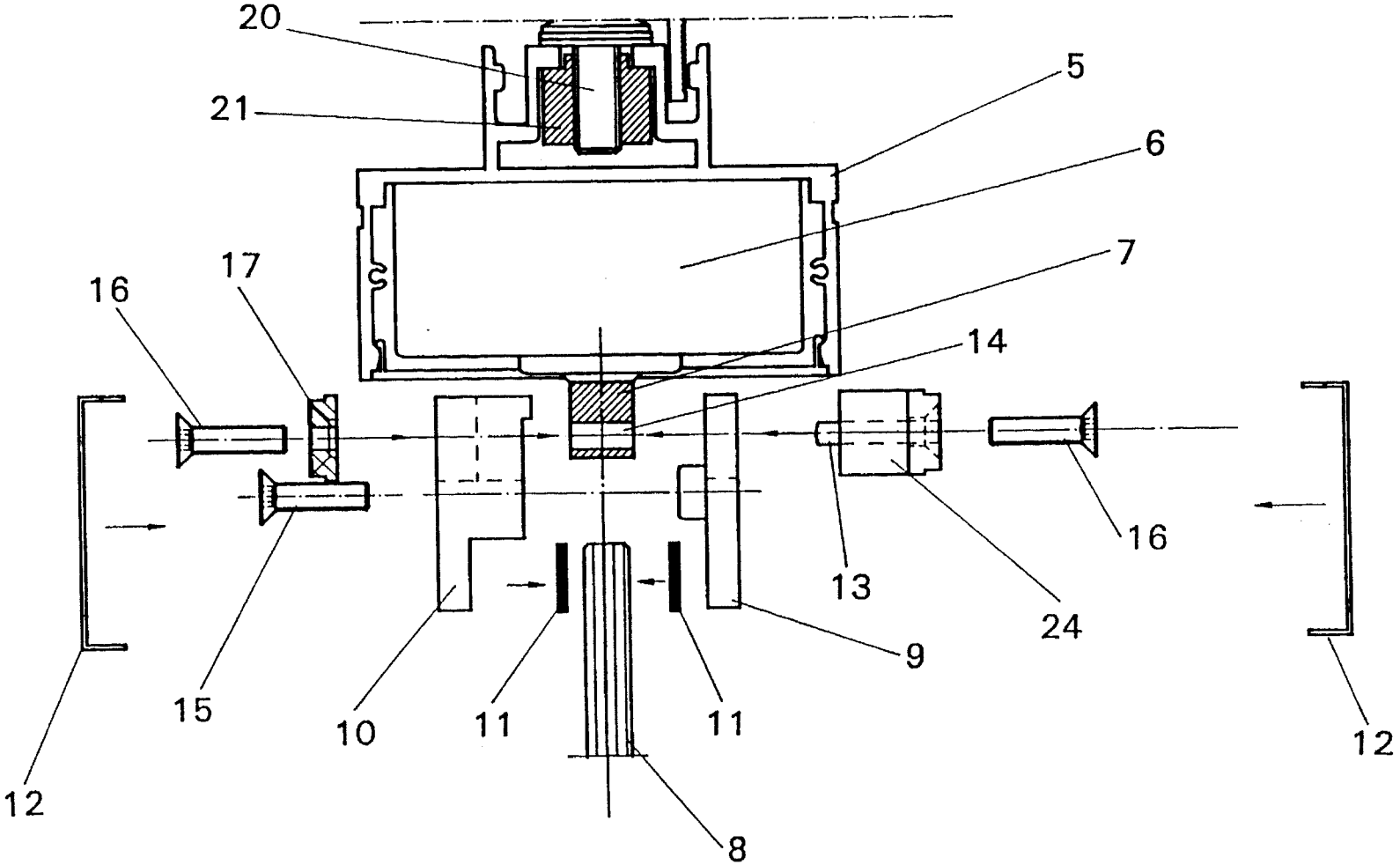
FIG. 2 shows the installation of the coupling.

FIG. 2 also shows an exploded view of an overall installation. The all-glass door (8) has rubber liners (11), which are inserted in the areas where the swinging door armatures (9) and (10) overlap the glass recess (23). The swinging door armatures (9) and (10) are connected to one another by the threaded connection (15). At the same time, the mounting (24) with the coupling pin (13) inside it is inserted into the swinging door armature (9). This mounting (24) is connected by means of the threaded connection (16) to the swinging door armature (9). In this position, the coupling pin (13) is engaged in the hole (14) in the drive shaft (7) of the frame-mounted door closer (6). So that the coupling pin (13) cannot slide out, a thrust plate (17) is placed on the opposite side, and is secured by means of the threaded connection (16) or another suitable fastening means. This guarantees that there is a secure and positive connection between the frame-mounted door closer (6) and the all-glass door (8). For cosmetic reasons, the entire sliding door armature is covered on both sides by cover plates (12).

Figure 3:
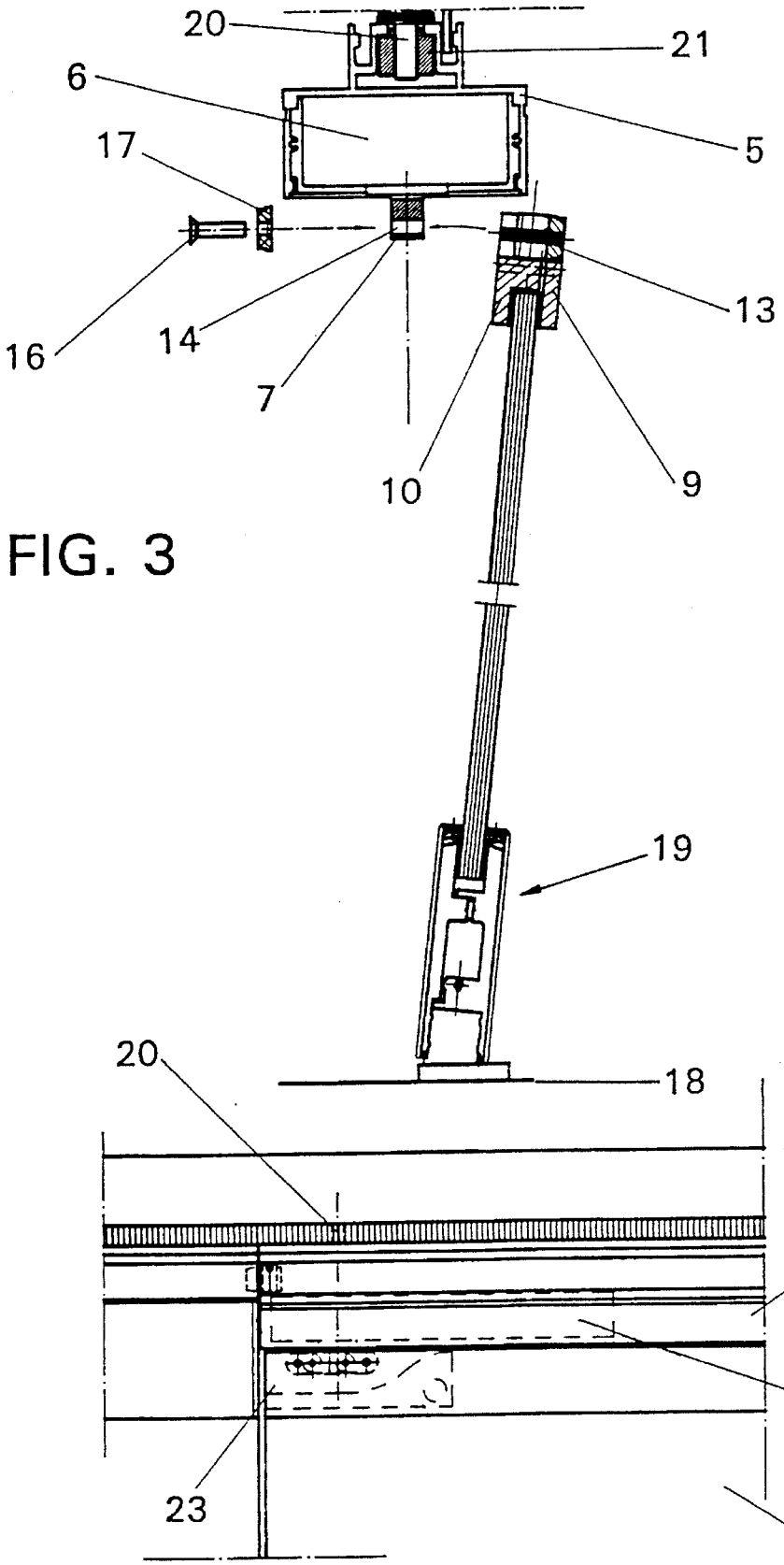
FIG. 3 shows the installation of the door.
Figure 4:
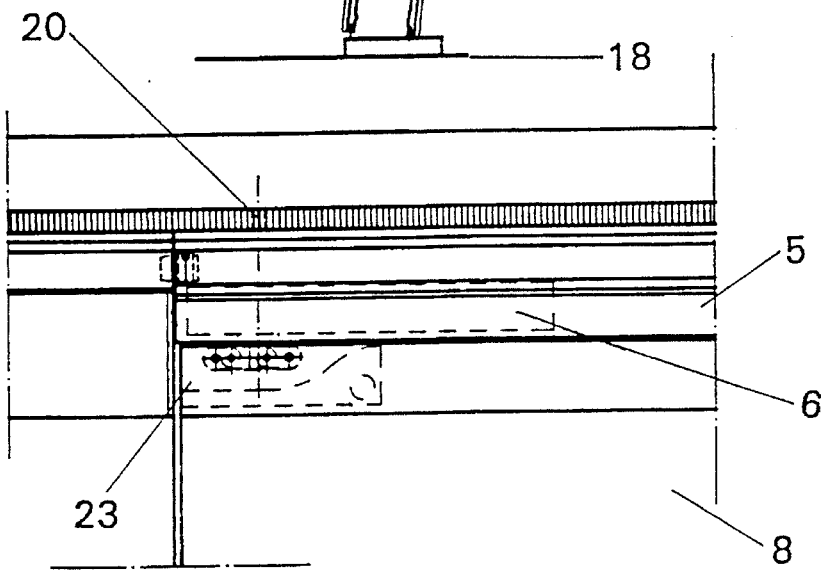
FIG. 4 shows a front view of the fully-installed door.

But the type of installation described above is not the normal installation, because it assumes that the door has been preassembled in the factory, along with all its armatures. This pre-assembled door panel, as shown in FIG. 3, is installed on the construction site. The floor brace (19) with the shaft pin is placed on the floor (18). The all-glass door (8) is then raised from a diagonal position and placed in the position in which the coupling pin (13) of the door can be engaged in the hole (14). Then, all that is necessary is to secure the thrust plate (17) by means of the threaded connection (16) to secure the door. If there are any uneven spots in the floor, any height correction which may be required can be made by using the height adjustment (3), which is located above the frame profile (5). As a result of this simple installation process, the unit can be installed quickly, and can move freely both in its swinging motion, and can also be moved along with part or all of the facade into a secure parked position, without removing the coupling between the door panel and the door closer. When the door is in a parked position, the entire floor or ground area is free of interfering connecting shafts.

Figure 5:
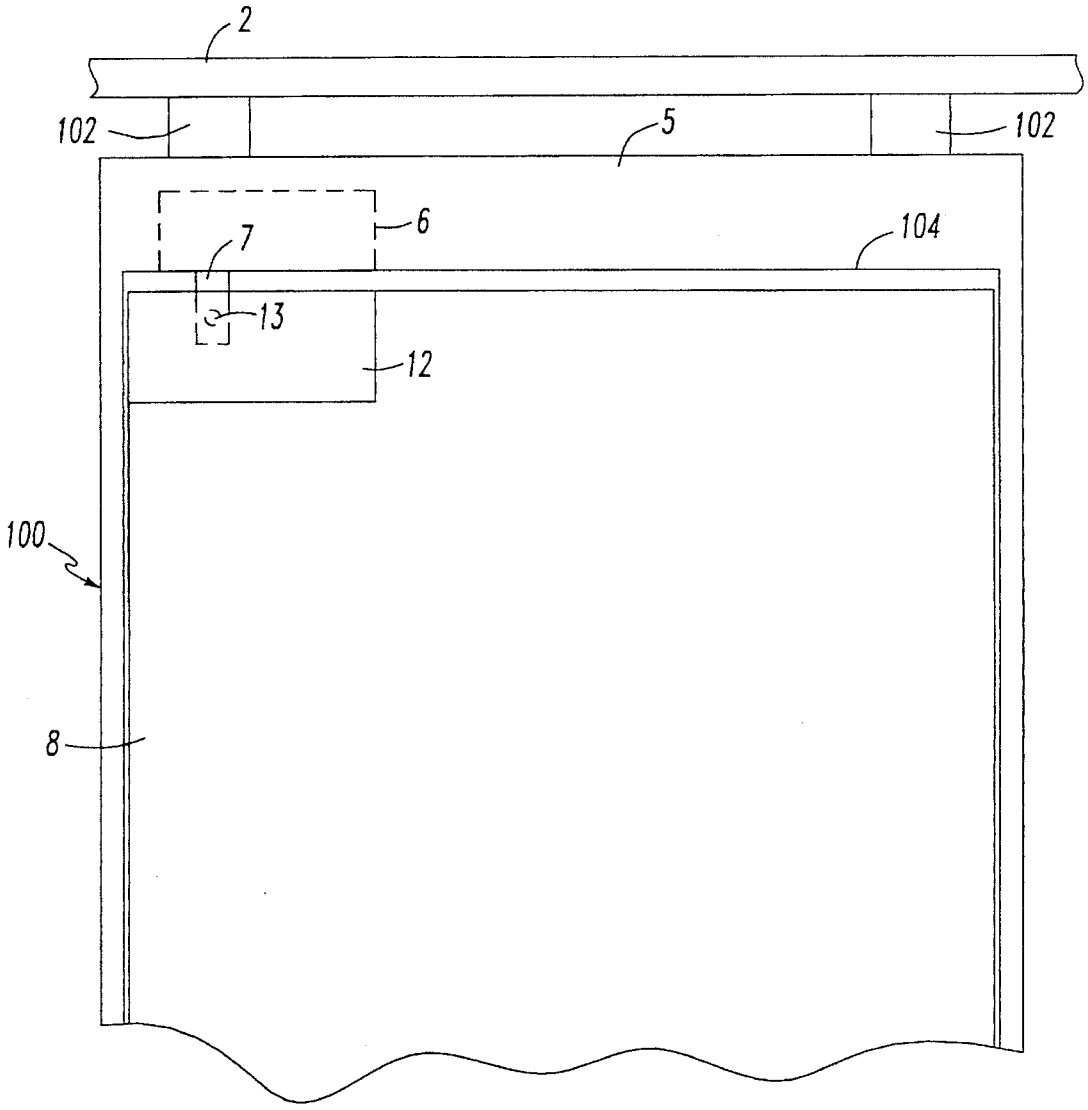
FIG. 5 is a schematic elevational view of a wall element, and associated components, in accordance with at least one embodiment of the present invention.
Figure 6:
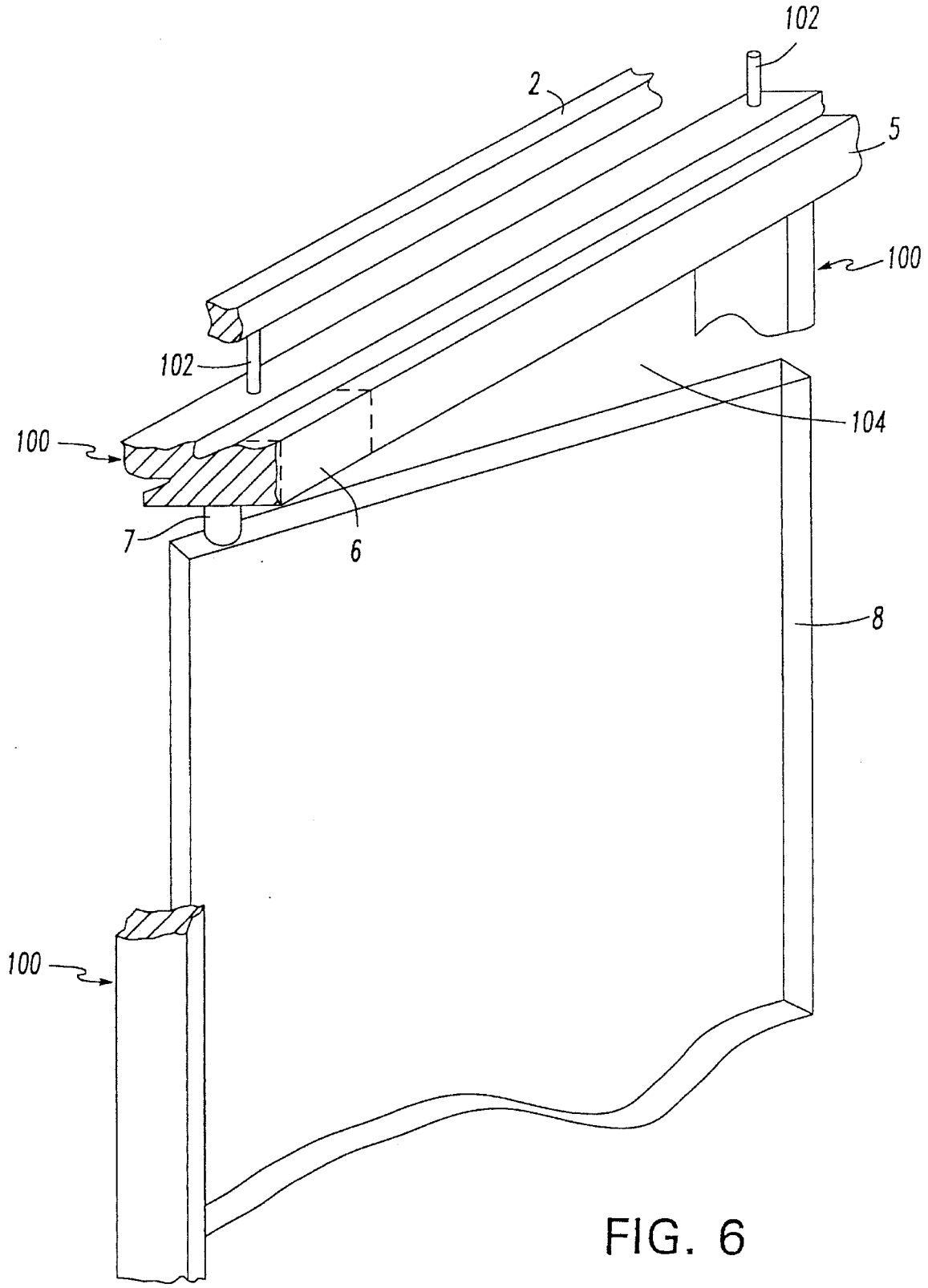
FIG. 6 is a perspective elevational view of a wall element according to a least one embodiment of the present invention.

To provide a better understanding of the location of various components, as well as their interrelationship, according to at least one embodiment of the present invention, reference is now made to FIG. 5 and 6.

FIG. 5 is a schematic elevational view of a wall element, and associated components, in accordance with at least one embodiment of the present invention. Particularly, a movable wall element 100, suspended from roller track 2 by a roller-and-suspension arrangement 102, preferably has a door-opening 104 disposed therewithin. As discussed heretofore, a door, such as an all-glass door 8, may preferably be provided within door-opening 104.

Preferably, concealed within what may be termed the "frame profile" 5, a door closer. 6 is mounted. Preferably extending downwardly from door closer 6 is a drive shaft 7, this preferably being connected to door 8 by way of a coupling pin 13, substantially as described heretofore. For cosmetic reasons, there may preferably be provided cover plates 12, in order to conceal the pins, armatures, and other components disposed therewithin.

Thus, in accordance with at least one preferred embodiment of the present invention, a movable wall system may be provided in which a swinging door 8 is provided within the wall element 100, so as to be pivotably displaceable with respect to wall element 100. Drive shaft 7, in conjunction with coupling pin 13, preferably supports door 8 with respect to wall element 100. Preferably, door closer 6 and drive shaft 7 are configured so as to urge the door 8 to return to a closed position with respect to wall element 100, to effectively close the door-opening 104, upon the door 8 being positioned in an open position with respect to wall element 100 and door-opening 104.

It will be understood, then, that in accordance with at least one preferred embodiment of the present invention, wall element 100 will essentially be slidably disposable with respect to roller track 2, while door 8 will be pivotably displaceable with respect to wall element 100, whereby, through its pivotable displacement, door 8 serves to essentially close the door-opening 104 of wall element 100 or, to varying degrees, open the door-opening 104.

FIG. 6 is a perspective elevational view of a wall according to a least one embodiment of the present invention. Particularly, FIG. 6 shows door 8 in a partly open position with respect to wall element 100. FIG. 6 shows the support of door 8, with respect to wall element 100, provided by drive shaft 7.

It is to be understood that FIGS. 5 and 6 are schematic illustrations intended merely for the purpose of providing a better understanding of various components of at least one embodiment of the present invention, and their interrelationship, and are in no way intended to limit the scope of the present invention.

The corresponding International Application No. PCT/DE92/00951, filed on Nov. 11, 1992, having inventor Herbert Kordes, is hereby incorporated by reference as if set forth in its entirety herein.

Nomenclature

1. Ceiling
2. Roller track
3. Height adjustment
4. Rollers
5. Frame profile
6. Frame-mounted door closer
7. Drive shaft
8. All-glass door
9. Swinging door armature
10. Swinging door armature
11. Rubber liners
12. Cover plates
13. Coupling pin
14. Mounting hole
15. Threaded connector
17. Backplate
18. Floor
19. Floor armature
20. Peg
21. Thrust bearing
23. Glass recess
24. Mounting

What is claimed is:

1. A movable wall system, said movable wall system comprising:

at least one movable wall panel for forming a wall;

guide rail means for guiding movement of said at least one wall panel;

means for movably supporting said at least one wall panel from said guide rail means above a floor;

said at least one wall panel comprising a door-opening therethrough;

a swinging door for being disposed in said door opening, said swinging door being pivotable within said door-opening between an open position and a closed position for opening and closing said door-opening;

door closer means for moving said swinging door from an open position to a closed position within said door-opening;

said door closer means being disposed within said at least one wall panel for being moved along with said at least one wall panel;

said door opening has a bottom portion disposed towards the floor, and a top portion disposed substantially above said bottom portion towards said guide rail mean;

said door closer means is disposed within said at least one wall panel at a position substantially above said door-opening and adjacent said top portion of said door opening;

said door closer means comprises a drive shaft for moving said swinging door from the open position to the closed position;

said drive shaft being configured to project downwardly from said door closer means towards a floor disposed below said at least one wall panel; and said drive shaft of said door closer means supporting said swinging door for thus moving said swinging door from the open position to the closed position.

2. The wall system according to claim 1 wherein:

said swinging door has a first side, and a second side opposite said first side, said first and second sides define therebetween a thickness dimension of said swinging door;

said drive shaft comprises a hole for being disposed parallel to said thickness dimension of said swinging door;

said door further comprises:

pin means for being disposed through said hole of said drive shaft to support said swinging door from said drive shaft; and means for retaining said pin means in said hole of said drive shaft to retain said swinging door in a fixed relationship with respect to said drive shaft for combined movement of said swinging door and said drive shaft.

3. The wall system according to claim 2, wherein:

said at least one wall panel further comprises a framework disposed at least above said door-opening; and said door closer is disposed and concealed within said framework above said door-opening.

4. The wall system according to claim 3, wherein:

said swinging door comprises:

a glass door panel, said glass door panel having an upper edge for being disposed towards said door closer means of said at least one wall panel, and said glass door panel having a first side and a second side; and an armature for being clamped about said glass door panel adjacent the upper edge of said glass door panel;

said armature comprises a first armature portion for being disposed adjacent said first side of said glass door panel and a second armature portion for being disposed adjacent said second side of said glass door panel;

said first and second armature portions defining a channel therebetween for clamping said glass door panel therebetween;

said armature further comprises means for fastening together said first and second armature portions to clamp said glass door panel therebetween in said channel; and said armature comprises means for receiving said pin means therethrough for affixing said armature to said drive shaft of said door closer means.

5. The wall system according to claim 4, wherein said armature is configured for being clamped about said glass door panel prior to installation of said glass door panel in said door-opening of said at least one wall panel.

6. The wall system according to claim 5, wherein:

said guide rail comprises a suspended track for being suspended above said at least one wall panel;

said means for movably supporting comprises carriage means for being guided along said track;

said carriage means comprises a plurality of rollers for movably supporting said carriage means on said track for permitting movement of said door panel along said track;

said carriage means further comprises means for connecting said carriage means to said at least one wall panel;

said means for connecting comprises a journal bearing; and said at least one wall panel comprises means for receiving and retaining said journal bearing.

7. The wall system according to claim 6, wherein:

said means for connecting comprises means for adjusting a height of said at least one wall panel with respect to a floor below said at least one wall panel;

said armature further comprises rubber liners for being disposed between said first and second armature portions and said glass panel to frictionally engage said glass panel between said first and second armature portions;

said armature further comprises cover plates for covering over said first and second armature portions;

said pin means comprises a pin mounting for being mounted to one of said first and second armature portions, said one of said first and second armature portions comprising means for receiving said pin mounting therein;

said armature further comprises means for affixing said pin mounting to said one of said first and second armature portions;

said means for retaining said pin means further comprises plate means for engaging the other of said first and second armature portions, said other of said first and second armature portions comprising means for receiving said plate means therein;

said swinging door further comprises a floor brace for being disposed about the bottom edge of said glass panel;

said track further comprises a substantially C-shaped track having a base portion with first and second L-shaped leg portions extending therefrom;

said C-shaped track defining an interior with a slot formed between said first and second L-shaped leg portions;

said carriage means is configured for being disposed within and travelling within the interior of said C-shaped track; and said means for connecting said carriage means to said at least one door panel comprises a rod disposed from said carriage means downwardly through said slot of said C-shaped track.

8. A method of installing and operating a movable wall system, the movable wall system comprising at least one movable wall panel for forming a wall, guide rail means for guiding movement of the at least one wall panel, means for movably supporting the at least one wall panel from the guide rail means above a floor, the at least one wall panel comprising a door-opening therethrough, a swinging door, the swinging door being pivotable within the door-opening between an open and a closed position for opening and closing the door-opening, door closer means for moving the swinging door from an open position to a closed position within the door-opening, the door closer means being disposed in the at least one wall panel for being moved along with the at least one wall panel, said method comprising the steps of:

providing guide rail means for guiding movement of the at least one wall panel;

providing at least one movable wall panel for forming a wall;

providing means for movably supporting the at least one wall panel from the guide rail means;

providing a door-opening through the at least one wall panel;

providing a swinging door for being disposed in the door-opening;

providing door closer means for moving the swinging door from an open position to a closed position within the door-opening; and mounting the door closer means in the at least one wall panel for movement of the door closer means along with the at least one wall panel; and said method further comprising the steps of:

installing the guide rail means at a position above a floor;

supporting the means for movably supporting from the guide rail;

connecting together the at least one wall panel and the means for movably supporting to support the at least one wall panel from the guide rail means;

moving the at least one wall panel along the guide rail means;

moving the door closer means along with the at least one wall panel;

the door-opening having a bottom portion disposed adjacent the floor, and a top portion disposed towards the guide rail means;

the at least one wall panel comprising a panel portion disposed above the door-opening adjacent the top portion of the door opening;

said disposing of the door closer means further comprises disposing the door closer means within the panel portion disposed above the door-opening;

the door closer means comprising a drive shaft for moving the door from an open position to a closed position, the drive shaft being configured to project downwardly from the door closer means towards a floor disposed below the at least one wall panel, the drive shaft for supporting the swinging for thus moving the door from an open position to a closed position;

said method further comprising the steps of:

disposing the door closer means in the wall panel with the drive shaft means projecting away from the panel portion above the door-opening and towards the floor; and supporting the swinging door with the drive shaft, for thus moving the door from the open position to the closed position.

9. The method according to claim 8, wherein the swinging door defines a thickness dimension, the drive shaft comprises a hole for being disposed parallel to the thickness dimension of the swinging door, the swinging door further comprises pin means for being disposed through the hole of the drive shaft to support the swinging door from the drive shaft, and means for retaining the pin means in the hole of the drive shaft to retain the swinging door in a fixed relationship with respect to the drive shaft for combined movement of the swinging door and the drive shaft, and said method further comprises the steps of:

said step of disposing the door closer means in the wall panel, with the drive shaft means projecting away from the panel portion above the door-opening and towards the floor, comprising the step of aligning the hole in the drive shaft parallel to the thickness dimension of the swinging door;

providing the pin means on the swinging door prior to insertion of the swinging door into the door opening;

after providing the pin means on the swinging door, inserting the swinging door in the door-opening to insert the pin means of the swinging door through the hole of the drive shaft to support the swinging door from the drive shaft; and retaining the pin means in the hole with the means for retaining to fix the swinging door in a fixed relationship with respect to the drive shaft for combined movement of the swinging door and the drive shaft.

10. The method according to claim 9, wherein the swinging door comprises: a door panel having an upper edge for being disposed towards the panel portion of the at least one wall panel and a lower edge for being disposed towards the floor, and the door panel having a first side and a second side; and the door panel additionally comprises an armature for being clamped about the door panel adjacent the upper edge of the door panel, the armature comprises a first armature portion for being disposed adjacent the first side of the door panel and a second armature portion for being disposed adjacent the second side of the door panel, the first and second armature portions defining a channel therebetween for clamping the door panel therebetween, the armature further comprises means for fastening together the first and second armature portions to clamp the door panel therebetween in the channel; and the armature comprises means for receiving the pin means therethrough for affixing the armature to the drive shaft of the door closer means, and prior to the disposing of the swinging door in the door-opening, the method further comprises the steps of:

clamping the door panel between the first and second armature portions in the recess formed between the first and second armature portions;

disposing the pin means through the armature;

after disposing the pin means in the armature, placing the lower edge of the door panel on the floor within the door-opening with the swinging door in a tilted position with respect to the at least one wall panel;

tilting the upper edge of the swinging door upwardly towards the drive shaft of the door closer disposed above the door-opening;

during the tilting, inserting the pin means in the armature through the hole of the drive shaft; and retaining the pin means in the hole of the drive shaft with the means for maintaining to thereby affix the armature to the drive shaft to support the swinging door from the drive shaft.

11. The method according to claim 10, further comprising:

configuring the door panel to comprise a glass door panel;

configuring the at least one wall panel to further comprise a framework disposed at least above the door-opening;

configuring the door closer means for being disposed within the framework above the door-opening; and disposing and concealing the door closer means within the framework above the door-opening.

12. The method according to claim 11, further comprising:

configuring the guide as a suspended track for being suspended above the at least one wall panel, and suspending the track above the at least one wall panel;

configuring the means for movably supporting as carriage means for being guided along the track;

providing the carriage means with a plurality of rollers for movably supporting the carriage means on the track for permitting movement of the door panel along the track;

providing the carriage means with means for connecting the carriage means to the at least one wall panel, the means for connecting comprises a journal bearing;

providing the at least one wall panel with means for receiving and retaining the journal bearing;

connecting the at least one wall panel to the carriage means via the journal bearing;

providing the means for connecting with means for adjusting a height of the at least one wall panel with respect to a floor below the at least one wall panel and adjusting the height of the at least one wall panel with the means for adjusting;

providing rubber liners for being disposed between the first and second armature portions and the glass panel to frictionally engage the glass panel between the first and second armature portions;

disposing the rubber liners adjacent the first and second sides of the glass door panel at the upper edge of the glass door panel and clamping the glass door panel with the rubber liners between the first and second armature portions;

providing cover plates for covering over the first and second armature portions;

covering the first and second armatures with the cover plates;

providing the pin means with a pin mounting for being mounted to one of the first and second armature portions;

providing the one of the first and second armature portions with means for receiving the pin mounting therein;

disposing the pin mounting in the means for receiving the pin mounting of the one of the first and second armature portions;

affixing the pin mounting to the one of the first and second armature portions;

providing the means for retaining the pin means with plate means for engaging the other of the first and second armature portions;

providing the other of the first and second armature portions with means for receiving the plate means therein;

after disposing the pin means through the hole of the drive shaft, engaging the plate means with the other of the first and second armature portions by the means for retaining the pin means in the hole of the drive shaft;

providing the swinging door with a floor brace for being disposed about the bottom edge of the door panel;

configuring the track as a substantially C-shaped track having a base portion with first and second L-shaped leg portions extending therefrom; the C-shaped track defining an interior with a slot formed between the first and second L-shaped leg portions;

disposing the carriage means within the interior of the C-shaped track;

moving the carriage means within the interior of the track to move the at least one wall panel; and configuring the means for connecting the carriage means to the at least one door panel as a rod disposed from the carriage means downwardly through the slot of the C-shaped track.

13. A door closer for a swinging door in a movable wall system, such a movable wall system comprising at least one movable wall panel for forming a wall, guide rail means for guiding movement of the at least one wall panel, means for movably supporting the at least one wall panel from the guide rail means above a floor, the at least one wall panel comprising a door-opening therethrough, the swinging door for being disposed in the door-opening and for being pivotable within the door opening between an open position and a closed position for opening and closing the door-opening, the door opening having a bottom portion disposed towards the floor and a top portion disposed substantially above the bottom portion; said door closer comprising:

means for moving a swinging door from an open position to a closed position within a door-opening in at least one movable wall panel in a movable wall system;

said door closer being dimensioned to be disposed in at least one movable wall panel, for being moved along with at least one movable wall panel;

said door closer means is dimensioned to be disposed in at least one movable wall panel at a position substantially above a door-opening and adjacent a top portion of a door-opening;

said moving means comprising a drive shaft for moving a swinging door from an open position to a closed position;

said drive shaft being configured to project downwardly from said door closer towards a floor disposed below at least one movable wall panel; and said drive shaft comprising means for supporting a swinging door for thus moving a swinging door from an open position to a closed position.

14. The door closer according to claim 13, wherein a swinging door to be supported by said drive shaft has a first side, and a second side opposite the first side, the first and second sides defining therebetween a thickness dimension of the swinging door, and further wherein:

said drive shaft comprises a hole for being disposed parallel to the thickness dimension of a swinging door;

said hole being configured for receiving pin means to support said swinging door from said drive shaft, such pin means for being retained in said hole of said drive shaft to retain a swinging door in a fixed relationship with respect to said drive shaft for combined movement of a swinging door and said drive shaft.

15. The door closer according to claim 14, wherein said door closer is dimensioned to be disposed and concealed within a framework above a door-opening of at least one wall panel.

* * * * *

UNITED STATES PATENT AND TRADEMARK OFFICE

CERTIFICATE OF CORRECTION

PATENT NO. : 5,544,462
DATED : August 13, 1996
INVENTOR(S) : Herbert KORDES

It is certified that error appears in the above-indentified patent and that said Letters Patent is hereby corrected as shown below:

In column 2, after line 20, insert the following new line:
--BRIEF DESCRIPTION OF THE DRAWINGS--.

In column 2, lines 25-26, before 'FIG.' delete "BRIEF DESCRIPTION OF THE DRAWINGS".

In column 4, line 67, Claim 1, after 'rail', delete "mean;" and insert --means;--.

Signed and Sealed this

Twenty-first Day of January, 1997

*Attest:*

*Attesting Officer*

BRUCE LEHMAN

*Commissioner of Patents and Trademarks*